United States Patent [19]

Homer

[11] Patent Number: 5,049,894

[45] Date of Patent: Sep. 17, 1991

[54] LAUNCH SUPPORT FOR THREE-LAYER RADAR MEMBRANE

[75] Inventor: Peter K. Homer, Langhorne, Pa.

[73] Assignee: Grumman Aerospace Corporation, Bethpage, N.Y.

[21] Appl. No.: 580,584

[22] Filed: Sep. 11, 1990

[51] Int. Cl.[5] ..... H01Q 1/12

[52] U.S. Cl. ..... 343/878; 343/892

[58] Field of Search ..... 343/878, 879, 880, 877, 343/888, 892, 893; 342/10

[56] References Cited

U.S. PATENT DOCUMENTS 1,855,155 4/1932 Sampson ..... 343/878

3,331,075 7/1967 Moulton ..... 343/877

3,577,196 5/1971 Pereda ..... 343/915

*Primary Examiner*—Michael C. Wimer

*Assistant Examiner*—Hoanganh Le

*Attorney, Agent, or Firm*—Pollock, VandeSande & Priddy

[57] ABSTRACT

A line of paired, oppositely extending bracket members is snapped together on the ground plane of a three-layer radar membrane. Antenna plane strips are horizontally located above and below the ground plane. Sufficient space occurs between confronting edges of antenna plane strips to allow extension of the brackets therebetween when the membrane is rolled up. Radially adjacent bracket members interlock to prevent axial displacement of the rolled ground plane.

8 Claims, 2 Drawing Sheets

LAUNCH SUPPORT FOR THREE-LAYER RADAR MEMBRANE

RELATED APPLICATIONS

This invention relates to the technology of copending U.S. Patent Applications Ser. No. 07/573,808 filed Aug. 28, 1990; Ser. No. 07/580,583, filed Sept. 11, 1990; and Ser. No. 07/580,578, filed Sept. 11, 1990, by the same inventor and assigned to the same assignee.

FIELD OF THE INVENTION

The present invention relates to window shade radar antennas having multiple layer membranes, and more particularly to a launch support mechanism for such a membrane when stored in a rolled condition.

BACKGROUND OF THE INVENTION

The prior art includes a "window shade" deployed space-fed phased array radar antenna which is particularly suited for use in space. The rolled antenna is advantageous because it minimizes storage space aboard a spacecraft. When the spacecraft achieves selected orbit, the antenna is deployed and the "window shade" structure becomes unrolled to a fully expanded operative condition. Such an antenna consists of a low-power RF feed which illuminates a lens aperture membrane. Active transmit/receive (T/R) modules in the aperture membrane receive radar pulses from the ground, amplify them, and perform beam-steering phase shifts so that the signal may be re-transmitted toward a target of interest in space. The reflected energy is received in reverse order, being amplified by the T/R modules then focused back onto the space feed. Radar processors and supporting subsystems are located in a bus at the base of a feed mast. A tensioned three-layer membrane constitutes the aperture and provides a very lightweight, yet sufficiently flat, aperture plane. Array flatness requirements for the space-fed approach are less severe than for corporate-fed approaches by an order of magnitude. The membrane aperture can be rolled up onto a drum resulting in a simple, compact, and repeatable method for deployment/retraction of the antenna.

When being launched into space, in order to assure that a multiple layer membrane structure remains neatly wrapped about a drum when subjected to high "G" forces of launch, means must be found for supporting the membrane structure on the drum so as to prevent the various wrapped layers from sliding relative to one another and unraveling. Such unraveled windings of the multi-layer membrane will jam a deployment mechanism which becomes operative when an appropriate orbit is reached.

BRIEF DESCRIPTION OF THE PRESENT INVENTION

The present invention offers simply constructed snap-on brackets which become affixed to the ground plane of a membrane assembly.

The membrane assembly of the present invention is a three-layer assembly having a central ground plane separating upper and lower antenna planes. The antenna planes are formed by co-planar strips positioned in spaced sidewise relationship. The brackets of the present invention are affixed to the ground plane and extend through the space between adjacent antenna planes. When the entire three-layer membrane structure is rolled, the various brackets interlock so as to prevent the various windings of the membrane assembly, rolled on a drum, from axial displacement along the drum.

The brackets of the present invention are retained on the ground plane by means of integrally formed snap fasteners. These allow a launch support mechanism to be installed on the membrane in a fast and efficient manner at a relatively low cost.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

The basic membrane of a window shade deployed antenna of the present type comprises three layers. A first layer is a ground plane and additional layers include spaced antenna planes above and below the ground plane. When the membrane is stowed, it is rolled up upon a drum so as to render a compact package.

Figure 2:
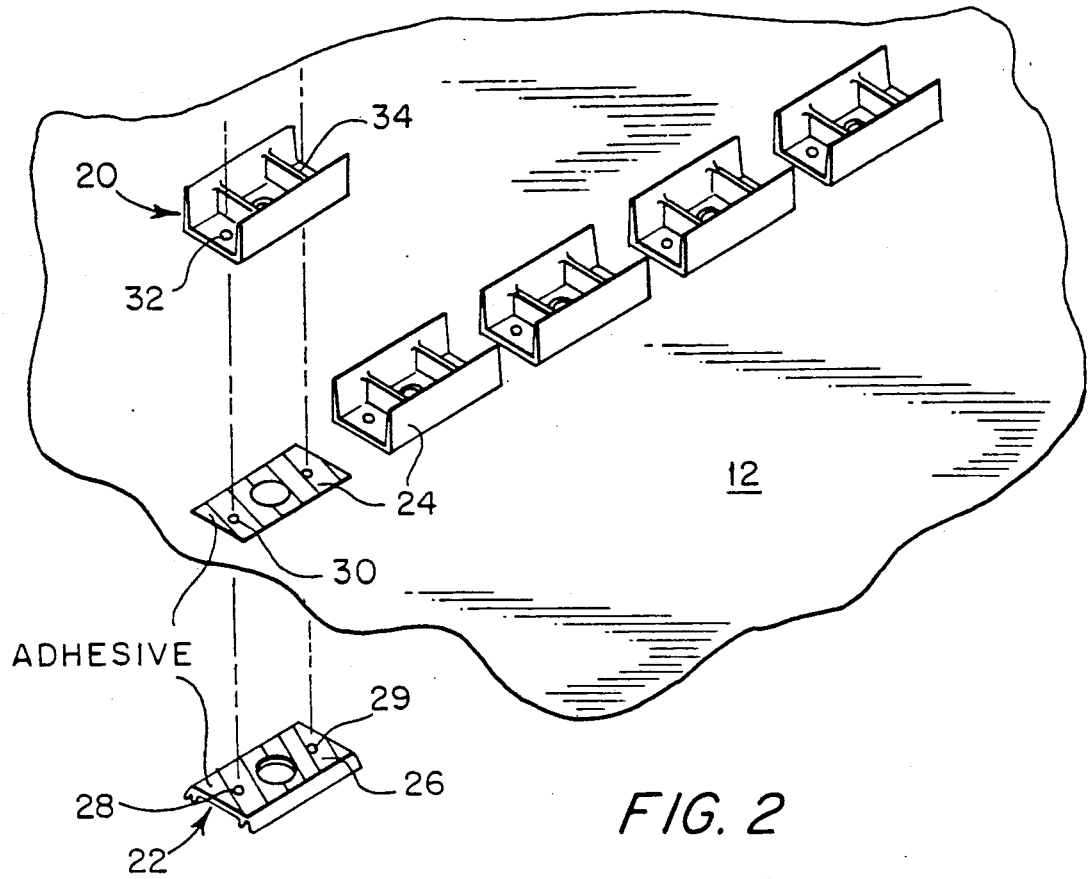
FIG. 2 is a partial perspective view illustrating disassembled brackets of the present launch support.
Figure 1:
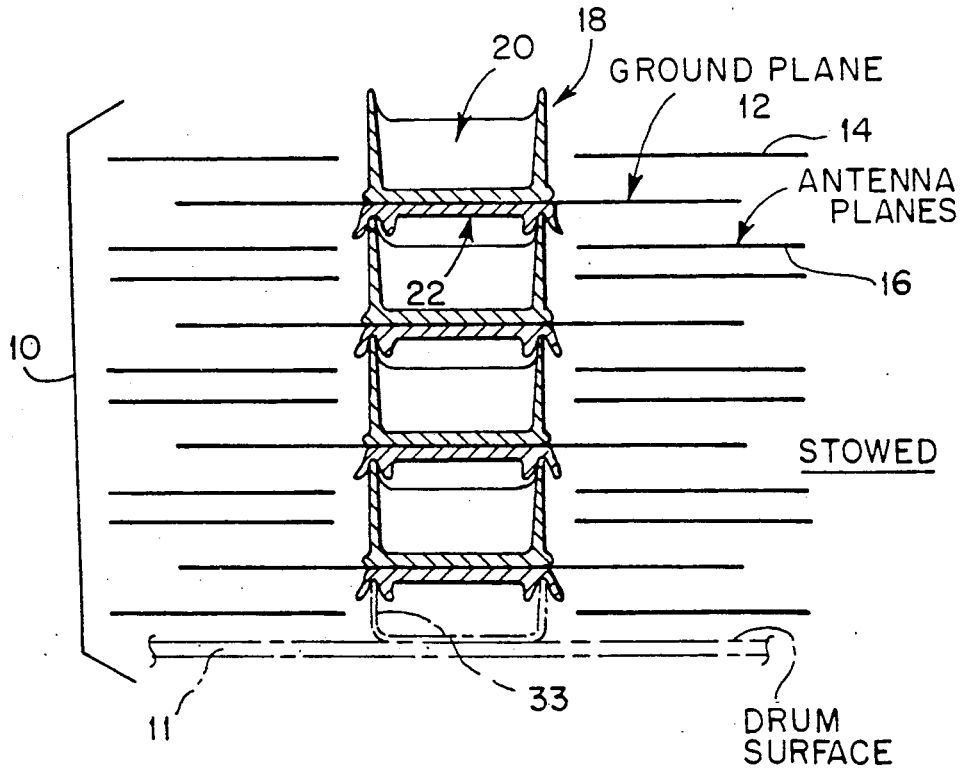
FIG. 1 is a partial sectional view through a rolled membrane structure showing the various windings of the membrane interlocked by means of the present launch support brackets.

FIG. 1 illustrates a plurality of windings for a rolled three-layer membrane generally indicated by reference numeral 10. These windings are centrally mounted on a drum, the surface of which is indicated by reference numeral 11. Each winding upon the drum surface includes a ground plane 12 bounded above and below by antenna planes 14 and 16, respectively. By employing interlocking brackets between vertically adjacent ground planes, it is possible to support the wound membrane against axial displacement. In FIGS. 1 and 2 the upper bracket of each launch support assembly is generally indicated by reference numeral 20, while a lower bracket is generally indicated by reference numeral 22.

As shown in FIG. 2, a number of upper brackets 20 are longitudinally spaced along the length of a ground plane upper surface while lower brackets 22 are respectively positioned in alignment with each upper bracket 20, but along the lower surface of the ground plane 12. The combination of an upper bracket 20 and lower bracket 22 constitutes a single launch support assembly generally indicated by reference numeral 18 in FIG. 1. These assemblies are spaced relative to the length of the ground plane so as to cause radial alignment of launch support assemblies and interlocking therebetween, as shown in FIG. 1. As will be appreciated from viewing FIG. 1, horizontally positioned antenna plane strips rest side by side with a space in between to permit the upper bracket 20 to project therebetween.

Referring to FIG. 2, the upper bracket 20 and lower bracket 22 are seen to be initially maintained against the respective upper and lower ground plane surfaces by means of double-stick adhesive pads 24 and 26. The base of lower bracket 22 has integrally molded male snap members 28 and 29 which pass through pre-formed holes in adhesive pad 26 as well as the ground plane 12. These snap members are aligned with mating female snap members openings 32 and 34 in the upper bracket 20 thereby permitting the upper and lower brackets 20 and 22 to be snap-mounted to the ground plane 12. A spacer 33 (FIG. 1) may be employed with each of lower brackets 22 positioned immediately adjacent the drum surface 11.

Figure 3:
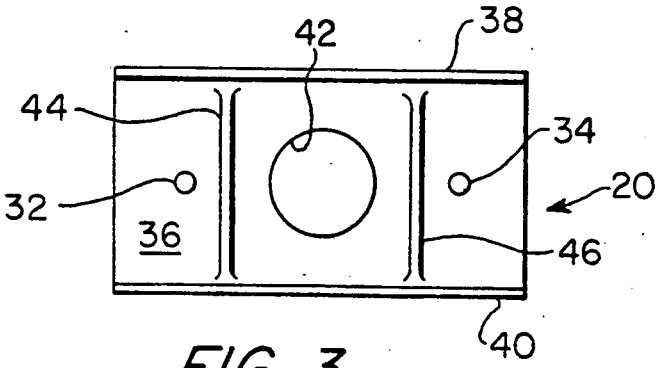
FIG. 3 is a top view of a first bracket employed in the launch support of the present invention.
Figure 4:
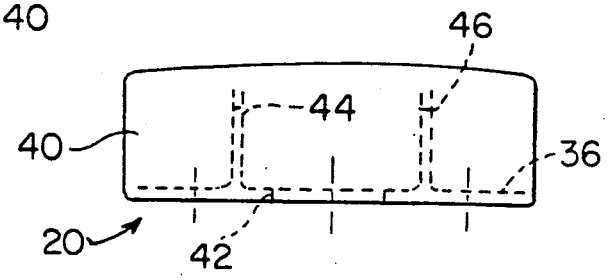
FIG. 4 is a side view of the bracket shown in FIG. 3.
Figure 5:
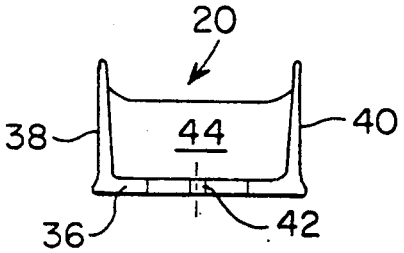
FIG. 5 is an end view of the bracket shown in FIG. 4.

FIGS. 3–5 indicate the construction of the upper bracket 20 in greater detail. The base 36 of the upper bracket has two parallel flanges 38 and 40 integrally formed therewith. A central opening 42 is formed in the base 36 as a weight-saving measure. Transverse ribs 44 and 46 bound the opening 42 and are integrally connected with the flanges 38 and 40. The ribs 44 and 46 add structural integrity to the bracket structure.

Figure 6:
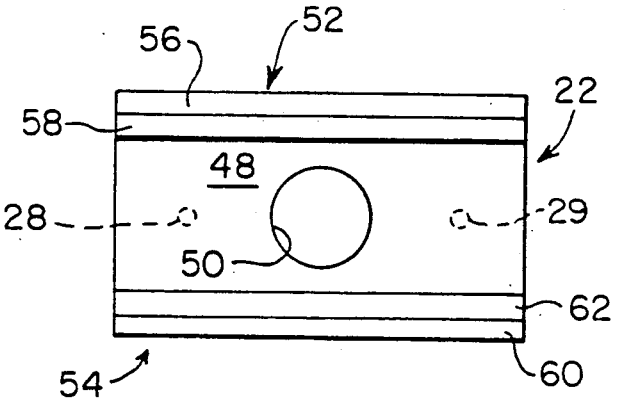
FIG. 6 is a top view of a second bracket as employed in the launch support of the present invention.
Figure 7:
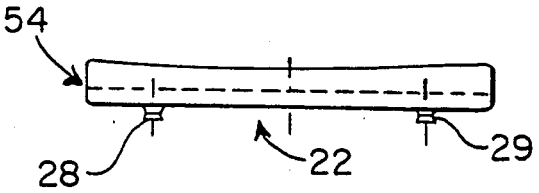
FIG. 7 is a side view of the bracket shown in FIG. 6.
Figure 8:
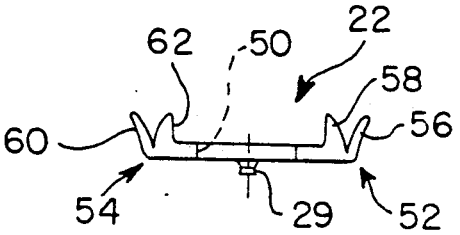
FIG. 8 is an end view of the bracket shown in FIG. 7.

FIGS. 6–8 illustrate the structure of the lower bracket 22. This bracket includes a central opening 50 in its base 48 which reduces resultant weight. Parallel side edges 52 and 54 run along the length of the bracket. The upper side 52 includes two adjacently and parallel-positioned flanges 56 and 58 which taper inwardly toward the base. Similarly, the side 54 comprises adjacent parallel flanges 60 and 62 which taper inwardly toward the base 48. As clearly shown in FIG. 1, the tapered flanges are particularly suited to seat a respective flange of a radially inwardly adjacently positioned upper bracket 20. Although FIG. 1 shows one radial line of interlocking brackets, it should be understood that the membrane may be comprised of a series of horizontally adjacently positioned antenna planes having a space between each set of confronting edges. In order to prevent axial sliding displacement of the various windings of a ground plane, several sets of axially spaced launch support assemblies may be employed.

The present invention is particularly suited for supporting or anchoring adjacently positioned windings of the ground plane. In my previously identified co-pending application dealing with a hinge bar assembly, means are discussed for preventing relative displacement between the antenna planes. The result of these two invention ensures that all of the layers of the membrane as wound around a drum will remain tightly wound during launch of a spacecraft thus ensuring proper deployment from the drum when a selected orbit is achieved.

It should be understood that the invention is not limited to the exact details of construction shown and described herein for obvious modifications will occur to persons skilled in the art.

I claim:

1. A support for a multi-layered membrane rolled on to a drum, the membrane having a ground plane layer; and at least one antenna plane layer including a plurality of spaced adjacent coplanar sheets positioned in rolled radial spaced relationship with the ground plane layer, the support including a plurality of interlocking bracket assemblies, each of which comprises:

a first bracket secured to a first surface of the ground plane layer and having spaced flanges disposed generally longitudinally of the drum and extending through the space between adjacent antenna plane sheets; and a second bracket secured to an opposite surface of the ground plane having notch means for engaging the flanges of a radially aligned and adjacent first bracket;

thereby minimizing axial shifting of the membrane on a central drum.

2. The structure set forth in claim 1 together with double-stick sided adhesive pads secured to bases of the first and second brackets for individually mounting the brackets back-to-back on the ground plane.

3. The structure set forth in claim 2 together with snap fastener means formed in bases of the brackets for fastening together a first and a second bracket back-to-back on the ground plane.

4. The structure set forth in claim 1 together with snap fastener means formed in bases of the brackets for fastening together a first and a second bracket back-to-back on the ground plane.

5. A launch support for a three-layered window shade radar membrane rolled onto a drum, the membrane having a central ground plane layer bounded by upper and lower antenna planes respectively spaced from opposite surfaces of the ground plane, each antenna plane fabricated from adjacent spaced co-planar sheets, the support comprising a plurality of bracket pairs removably interlocked along a length of the rolled ground plane sheet, each bracket pair comprising:

a first bracket secured to a first surface of the ground plane and having spaced flanges disposed generally longitudinally of the drum and extending through the space between adjacent antenna plane sheets; and a second bracket secured to an opposite surface of the ground plane having notch means for engaging the flanges of a radially aligned and adjacent first bracket;

thereby minimizing axial shifting of the membrane on a central drum.

6. The structure set forth in claim 5 together with double-stick sided adhesive pads secured to bases of the first and second brackets for individually mounting the brackets back-to-back on the ground plane.

7. The structure set forth in claim 6 together with snap fastener means formed in bases of the brackets for fastening together a first and a second bracket back-to-back on the ground plane.

8. The structure set forth in claim 5 together with snap fastener means formed in bases of the brackets for fastening together a first and a second bracket back-to-back on the ground plane.

* * * * *